US008900685B2

(12) United States Patent
Carlson

(10) Patent No.: US 8,900,685 B2
(45) Date of Patent: Dec. 2, 2014

(54) STACK OF INTERFOLDED ABSORBENT SHEET PRODUCTS, AND METHOD OF FORMING THE SAME

(75) Inventor: Paul Carlson, Appleton, WI (US)

(73) Assignee: SCA Hygiene Products AB, Gothenburg (SE)

( * ) Notice: Subject to any disclaimer, the term of this patent is extended or adjusted under 35 U.S.C. 154(b) by 111 days.

(21) Appl. No.: 13/222,391

(22) Filed: Aug. 31, 2011

(65) Prior Publication Data

US 2013/0052408 A1 Feb. 28, 2013

(51) Int. Cl.

| | |
|---|---|
| ***B32B 3/04*** | (2006.01) |
| ***A47K 10/16*** | (2006.01) |
| ***B65H 45/24*** | (2006.01) |

(52) U.S. Cl.

CPC ..... *B65H 45/24* (2013.01); *B65H 2701/1924* (2013.01)

USPC ..... 428/126; 428/130

(58) Field of Classification Search

CPC ..... A47K 10/16; B32B 3/04

USPC ..... 428/126, 130; 221/48

See application file for complete search history.

(56) References Cited

U.S. PATENT DOCUMENTS

| | | | | |
|---|---|---|---|---|
| 3,285,599 | A | 11/1966 | Pherson et al. | |
| 3,291,479 | A | 12/1966 | Greiner et al. | |
| 5,118,554 | A | 6/1992 | Chan et al. | |
| 6,090,467 | A | 7/2000 | Yip | |
| 6,213,346 | B1 | 4/2001 | Skerrett et al. | |
| D462,530 | S | 9/2002 | Almvik | |
| 7,178,689 | B2 | 2/2007 | Wieser et al. | |
| 7,611,765 | B2 | 11/2009 | Hochtritt et al. | |
| 7,624,765 | B2 | 12/2009 | Burazin et al. | |
| 8,597,761 | B2 * | 12/2013 | Formon et al. | 428/124 |
| 2001/0025856 | A1 | 10/2001 | Lefevre Du Grosriez et al. | |
| 2005/0056657 | A1 | 3/2005 | Hochtritt et al. | |
| 2006/0122574 | A1 | 6/2006 | Gooding, Jr. | |
| 2008/0135572 | A1 * | 6/2008 | Brennan et al. | 221/48 |

FOREIGN PATENT DOCUMENTS

| | | | |
|---|---|---|---|
| EP | 1 892 209 | | 2/2008 |
| JP | 4084907 | A | 3/1992 |
| WO | WO-2006/038921 | A1 | 4/2006 |
| WO | WO-2010/025065 | | 3/2010 |

* cited by examiner

*Primary Examiner* — Alexander Thomas

(74) *Attorney, Agent, or Firm* — Drinker Biddle & Reath LLP

(57) ABSTRACT

A stack of interfolded absorbent sheet products includes a plurality of absorbent sheets. Each sheet product includes a first fold, a second fold running parallel to the first fold, and a third fold which is perpendicular to the first and second folds, so that the three folds define a pattern of 3×2 panels, including two first side panels, two center panels, and two second side panels. Each sheet product has its first side panels folded onto its center panels, its second side panels folded onto its first side panels in a C-fold, and its second side panels then folded onto each other so as to obtain a folded configuration including at least six panels. Each sheet product within the stack receives between two inwardly facing adjacent panels three adjacent panels from each of two sheet products disposed respectively above and below the sheet product in the stack.

16 Claims, 2 Drawing Sheets

STACK OF INTERFOLDED ABSORBENT SHEET PRODUCTS, AND METHOD OF FORMING THE SAME

FIELD OF THE INVENTION

The disclosure relates to a stack of interfolded absorbent sheet products, and optionally, to a stack of interfolded absorbent sheet products bearing a predetermined pattern imparted by embossing or by formation by Through-Air Drying ("TAD") or by a structured tissue technique. The present disclosure also relates to a method of forming such a stack of interfolded absorbent sheet products.

BACKGROUND

In commercial food service establishments and public restrooms, folded paper products such as paper napkins are typically provided in dispensers from which the products may be withdrawn by the patrons of those establishments. It is desired to provide paper products in the user-dispensed application that are perceived as being of relatively high quality.

Interfolded paper products, and especially interfolded paper napkins, have the advantage that they can be loaded into a dispenser whose faceplate cooperates with the stack of napkins to encourage users to remove napkins one at a time. This results in users taking fewer napkins than if it were possible or encouraged to remove a group of napkins simultaneously, although the paper product stack of the disclosure may be used in dispensers that promote either one at a time or group dispensing.

Interfolded paper napkins applied to a user-dispensed environment include those that are single folded only.

Paper napkins that are single folded only (sometimes also called "half-folded" when the fold bisects the napkin, or "off-folded" when it does not) have the disadvantage that, in order to achieve a given total absorbency, the basis weight of the unfolded napkin sheet must be relatively high. This in turn causes the napkin to have relatively low softness and drape properties, both of which properties are important to the user's perception of the total quality of the napkin.

Patent literature describes a variety of arrangements of interfolded paper napkins having plural parallel folds, for example, in U.S. Pat. Nos. 5,118,554, 6,090,467 and 6,213,346. The provision of plural parallel folds in a napkin has the obvious limitation that the napkin will have a relatively elongated shape in the direction parallel to the folds, unless the starting blank is cut to a relatively more elongated shape in the direction perpendicular to the folds.

Known interfolded paper napkins also include those that are folded at least twice about axes that are perpendicular to one another, as described in commonly-owned U.S. Pat. No. 7,611,765, the entirety of which patent is hereby expressly incorporated by reference. In embodiments of that patent wherein two folds each bisect the base napkin sheet, the area of the unfolded sheet will be approximately four times that of the folded napkin. The dimensions of the unfolded sheet can be about 8.5"×13", such that the folded napkin will have dimensions of about 4.23"×6.5". Also disclosed is a six panel embodiment in which each individual napkin is folded along a first fold which bisects the napkin, and then along a second and a third fold into a "Z" configuration. In the stack, the uppermost napkin has its four lower panels sandwiched between two adjacent panels of the next lower napkin in the stack, whose lower four panels are in turn sandwiched between the lowermost two panels of the top napkin, and the uppermost two panels of the third napkin. In other words, each sheet has one third of its total area interfolded with one adjacent sheet but two thirds interfolded with the other adjacent sheet, which imparts an imbalance to the overall structure.

Folded sheet products having six panels are also known from US 2006/0122574 A1 and EP 1 892 209 A2. The sheets are, however, not interfolded.

SUMMARY

The present disclosure provides a stack of interfolded absorbent sheet products including a plurality of absorbent sheet products, wherein each sheet product includes a first fold, a second fold running parallel to the first fold, and a third fold which is perpendicular to the first and second folds, so that the three folds define a pattern of 3×2 panels, including two first side panels, two center panels, and two second side panels. Each sheet product has its first side panels folded onto its center panels, its second side panels folded onto its first side panels in a C-fold, and its second side panels then folded onto each other so as to obtain a folded configuration including at least six panels.

As each sheet product within the stack receives between two inwardly facing adjacent panels three adjacent panels from each of two sheet products disposed respectively above and below the sheet product in the stack, there is still an overlap of up to 50% between two adjacent sheet products.

Preferred optional features are recited in the dependent claims.

The absorbent sheets may each have a generally rectangular shape, which may be square or non-square. If so, the first and second folds are parallel to one side of the rectangle. In case the absorbent sheets each have a non-square rectangular shape, the first and second folds are parallel to the short sides of the rectangle. In case the sheet products are square and have four equal sides, the first and second folds run parallel to one of the sides of the square, and the third fold is perpendicular to the first and second ones.

The first, second and third folds may define six panels of equal width and length. If so, the surface area of the folded sheet is reduced to one sixth if compared with the surface of the unfolded sheet. This means that the surface of the folded sheet product is relatively small if compared with the surface of the unfolded sheet product.

Within embodiments of the invention it is, however, also possible to fold the sheet products so that the size of the individual panels is different. In particular, the sheet products could be provided so that the first side panels and the second side panels are narrower than the center panels onto which they are folded. The size of the folded product would then be determined by the size of the larger center panels.

The third fold may or may not be arranged so as to bisect the sheet. It can as well be offset from the center of the product and does not necessarily bisect the product into two equal parts.

Each of the absorbent sheet products may have folded dimensions of approximately 4.25" by 4.25". The unfolded dimensions may be approximately 8.5" by 13".

The absorbent sheet products may be single ply or multi-ply paper sheets. In both cases, each ply (i.e. the single ply or each ply of the multi-ply product) may have a basis weight of from about 8 to 20 lb, particularly from about 11 to about 17 lb, more particularly from about 12 to about 15 lb, and yet more particularly about 13 lb. The latter basis weight particularly applies in case the sheet product is a paper napkin.

In general, the weight, measured in pounds (lb), of 500 sheets (a ream) of paper cut to a standard size is its basis weight. The expression of "basis weight" in pounds as used herein is with reference to a stack of 500 unfolded single ply sheets each measuring 24 by 36 inches.

The sheet products may have a folded configuration including more than six panels. For example, each of the absorbent sheet products may include at least two interconnected layers of six panels, each of which are folded onto each other.

Each of the absorbent sheet products may be entirely detached from all other absorbent sheet products within the stack, or each of the absorbent sheet products may be attached by tabs to one or two other absorbent sheet products within the stack.

While the sheet products may not, each of the absorbent sheet products may bear an embossed surface relief applied by embossing rollers during a converting phase of manufacturing the absorbent sheet products.

Each of the absorbent sheet products may be TAD tissue or structure or textured tissue, made using a process using pressure, vacuum, or air flow through the wet web, each of the absorbent sheet products having an air side and a fabric side.

In case the products are embossed, the embossed surface relief may be of a continuous pattern over an entire surface of the absorbent sheet products, or the embossed surface relief may be applied only along a peripheral region of the absorbent sheet products.

The embossed surface relief pattern may include relief elements that project from one side of each absorbent sheet product and are recessed relative to an opposite side of each absorbent sheet product. Each absorbent sheet product can be folded such that exterior panels of each absorbent sheet product when folded include the relief elements that are recessed relative to the opposite side of each absorbent sheet product.

However, the opposite configuration could also be realized. The folds can be formed such that interior panels of each absorbent sheet product when folded include the relief elements that are recessed relative to the opposite side of each absorbent sheet product.

Where the absorbent sheet products have an air side and a fabric side, each absorbent sheet product may be folded such that exterior panels of each absorbent sheet product when folded includes the fabric side of each absorbent sheet product.

The absorbent sheet products may be provided in the form of paper napkins; however, many different applications are possible.

The present disclosure also provides a method of forming a stack of interfolded absorbent sheet products including a plurality of absorbent sheets. The method includes the steps of:

providing a continuous sheet web, folding the continuous sheet web in a C-fold along a first and a second fold running parallel to the side edges of the continuous web, cutting the sheet web into individual C-folded sheet products, and folding each sheet product onto itself along a third fold which is perpendicular to the first and second folds, so as to obtain a configuration including at least six panels in which the three folds define a pattern of 3×2 panels.

Simultaneously with the last folding step, the sheet products can be interleaved so as to form a stack in which each sheet product receives between two inwardly facing adjacent panels three adjacent panels from each of two sheet products disposed respectively above and below the sheet product in the stack.

The term "absorbent sheet products" as used herein embraces not only paper products such as paper napkins, but also absorbent nonwoven materials not normally classed as papers or tissues. Such nonwoven materials include pure nonwovens and hybrid nonwoven/pulp webs whose properties are similar to those of tissue paper, but which are based for example on nonwoven or airlaid materials containing low amounts of synthetic fibers, binders, wet strength agents and the like. An example of such a material would be a wetlaid or foam-formed hydraulically entangled nonwoven material including at least 30% by weight pulp fibers and at least 20% by weight manmade fibers or filaments.

BRIEF DESCRIPTION OF THE DRAWINGS

Other objects, features and advantages will become more apparent after reading the following detailed description of embodiments of the invention, given with reference to the accompanying drawings, in which:

FIG. 1(*b*) is a perspective view of the individual napkin of FIG. 1(*a*), in which a first fold is being formed;

FIG. 1(*c*) is a perspective view of the individual napkin of FIG. 1(*a*), in which a second fold is being formed;

FIG. 1(*d*) is a perspective view of the individual napkin of FIG. 1(*a*), in which the first and second folds are completed;

FIG. 1(*e*) is a perspective view of the individual napkin of FIG. 1(*a*), in which a third fold is being formed;

FIG. 1(*f*) is a perspective view of the individual napkin of FIG. 1(*a*), in which the third fold has been completed;

FIG. 2(*b*) is a schematic cross-sectional view of the napkin stack of the FIG. 2(*a*) embodiment.

DETAILED DESCRIPTION OF PREFERRED EMBODIMENTS

Figure 1A:
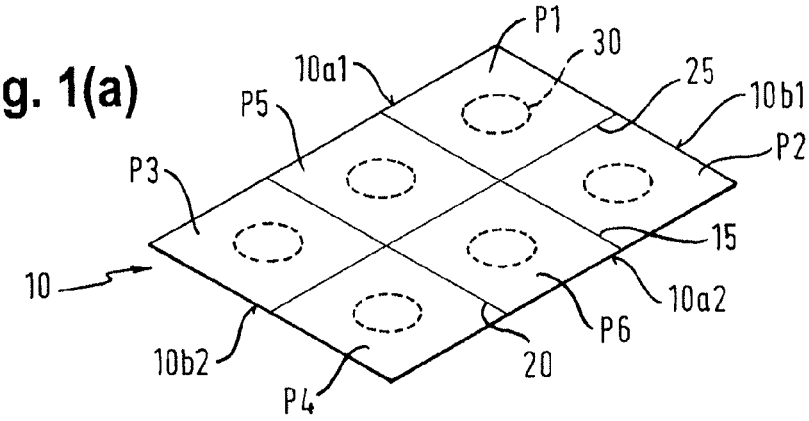
FIG. 1(*a*) is a perspective view of an individual unfolded napkin.
Figure 1B:
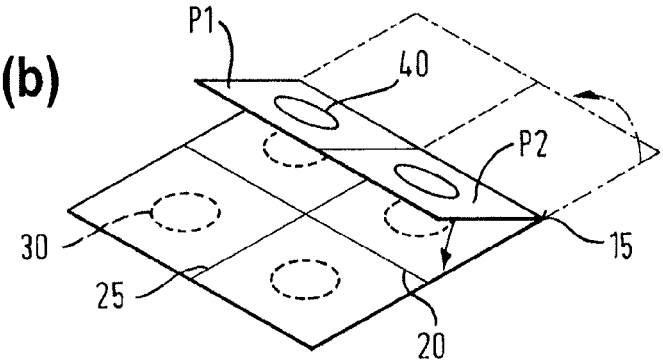
Figure 1C:
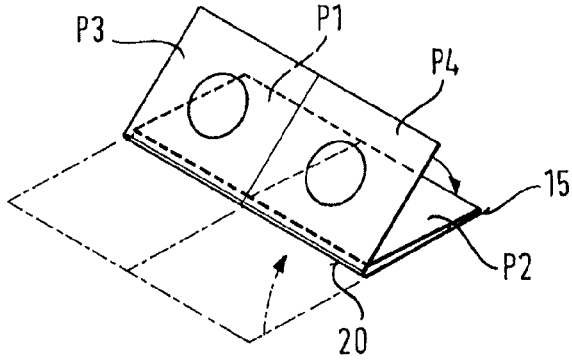
Figure 1D:
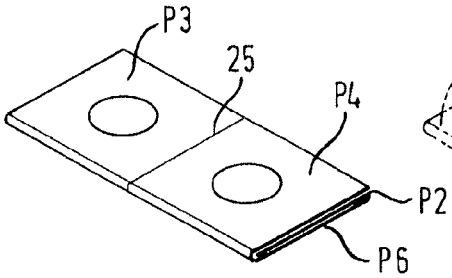
Figure 1E:
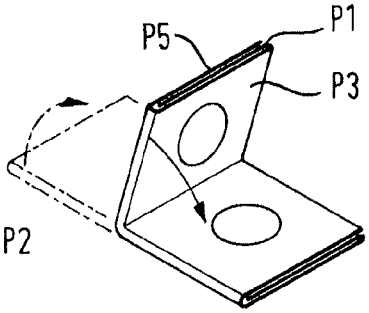
Figure 1F:
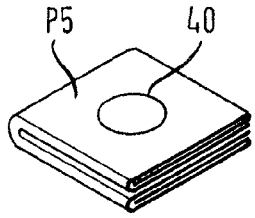

In FIG. 1(*a*), a sheet product 10 of absorbent material is depicted that has been folded and then unfolded so that the folding lines are apparent. The sheet product 10 (which will also simply referred to as a "sheet 10" in the following) of this embodiment is a non-square rectangle and has two long sides 10*a*1, 10*a*2 and two short sides 10*b*1, 10*b*2.

In FIG. 1(*a*) the sheet is depicted with its obverse side facing upwards, the obverse side being identified by dashed circles 30 which designate male embossing patterns. After folding and unfolding, the generated folding lines delimit six equally sized panels P1-P6 or, more specifically, two first side panels P1, P2; two second side panels P3, P4; and two center panels P5, P6. Consequently, the six panels form a pattern of 3×2 panels.

The absorbent sheets may be of a variety of types, including, without limitation, dry crepe tissue; wet crepe tissue; creped TAD (through air dried) tissue; uncreped TAD tissue; structure or textured tissue, made using a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; fabric creped tissue, made using a process including the step of transferring the wet web from a carrying surface (belt, fabric, felt, or roll) moving at one speed to a fabric moving at a slower speed (at least 5% slower) and subsequently drying the sheet. Those skilled in the art will recognize that these processes are not mutually exclusive, e.g., an uncreped TAD process may include a fabric crepe step in the process.

The present disclosure covers unembossed absorbent sheet products. The absorbent sheet products can, however, also be embossed. This particularly applies when the sheet products are provided in the form of paper napkins, which most often carry an embossing pattern As used herein, the term "embossed" connotes a three-dimensional low relief pattern of a distinct pattern or image. Such embossing may be applied by conventional embossing rollers during the converting phase of the sheet manufacturing, in particular embodiments, upstream of the folding and interfolding, and/or may be formed by a selected pattern of the TAD fabric, if the sheets are made by the TAD technique. Similarly, the term embossing as used herein may embrace the pattern imparted to structure or textured tissue by the textured papermaking fabrics used to make them, regardless of whether the textured papermaking fabrics include additional distinct design elements (see, for example, U.S. Pat. No. 7,624,765). The term "embossed" as used herein does not embrace, however, any incidental surface roughness imparted to a sheet by the forming fabric used in a traditional Yankee cylinder/dry crepe forming line, which surface roughness does not display any predetermined pattern to the unaided eye.

When the absorbent sheets are embossed during a converting phase utilizing embossing rollers, the embossing rollers may be of the type in which one roller bears a male pattern including all or a majority of projecting embossing elements, and the other roller bears a female pattern including all or a majority of cooperating recessed embossing elements. In FIGS. 1(*a*) through 1(*f*) such an embossing pattern in the form of circular elements 30 is schematically indicated, which project from the undisturbed plane of sheet 10. The projecting circular elements 30 thus form the "male" side of the embossed sheet 10, and are consequently formed by the sheet 10 passing between embossing rollers with the obverse side in contact with the female roller.

On the other hand, when the reverse surface of the sheet 10 is regarded, the circular elements appear as recessed circular elements 40 that are recessed from the undisturbed plane of sheet 10. Recessed circular elements 40 thus form the "female" side of the embossed sheet 10, and are consequently formed by the sheet passing between embossing rollers with the reverse side in contact with the male roller.

The specific pattern embossed onto the sheets may vary according to the application, with that illustrated in commonly-owned U.S. Design Patent No. D462,530 being one possibility. The embossing may be of a continuous pattern over the entire surface of the sheet, or the embossing may be applied only to selected regions of the sheet, e.g. along a periphery or a border thereof.

When the absorbent sheets are to be used as napkins in a commercial establishment, such as a food establishment—particularly a fast food franchise—or a convenience store, it may be desirable for the napkins to bear the name and/or the logo of the establishment in which the napkins will be dispensed. In that case the name and/or logo may be formed by embossing, or by printing the napkin with an ink that sufficiently contrasts with the color of the paper stock, or by a combination of those techniques.

The folded absorbent sheet products can be single ply paper napkins having a basis weight of from about 8 to 20 lb per unfolded sheet. In particular embodiments, the basis weight of the napkins can be from about 11 to about 17 lb. In more particular embodiments, the basis weight of the napkins can be from about 12 to about 15 lb, and yet more particularly about 13 lb. In general, the weight, measured in pounds (lb), of 500 sheets (a ream) of paper cut to a standard size is its basis weight. The expression of "basis weight" in pounds as used herein is with reference to a stack of 500 unfolded single ply sheets each measuring 24 by 36 inches. Thus, the basis weight of the absorbent sheet products can be within the range of a high quality napkin, and thus less than that of commercially available single folded paper products, whose higher basis weight places them closer to the category of paper towels. Particular embodiments have a basis weight of about 13 lb, calculated as defined above. However, it will be appreciated by those skilled in the art that the basis weight may vary over a broader range, for example, from about 10 to 20 lb per unfolded sheet, particularly from about 11 to about 17 lb, and more particularly from about 12 to about 15 lb.

While this range of basis weights is greater than that commonly used for facial tissue (wherein a basis weight of 8½ to 9 per ply is typical), it is distinctly less than the basis weights found in commercially available single-fold napkin/towels, which tend to have basis weights in excess of 20 lb. Thus, by providing a paper napkin wherein the sheet has a relatively low basis weight, yet the napkin is folded to have at least four panels, a napkin that is comparatively softer and has improved drape properties in relation to single fold products is provided.

The sheet 10 of absorbent material in this embodiment, prior to folding, can have dimensions of approximately 8.5"× 13". The six panels P1-P6 are square and have an edge length of 4.25". However, those dimensions may of course be varied to suit the particular desired application of the product. The edge length of the panels could for example be sized down to about 3.25".

The sequence in which the sheet 10 is folded is depicted in FIGS. 1(*b*) through 1(*f*). As shown in FIG. 1(*b*), the sheet 10 is first folded along a first fold 15. The first fold 15 is parallel to the short sides 10*b* of the sheet 10, and so in this embodiment has a length of 8.5". The first fold 15 is located so that it divides off approximately one third of the area of the sheet 10, or the two first side panels P1, P2 which are adjacent the first short side 10*b*1 of the rectangular sheet 10. Consequently, in this embodiment, the first fold 15 is approximately 4.25" from the near short side 10*b*1 of sheet 10, and approximately 8.5" from the far short side 10*b*2 of sheet 10.

The first side panels P1, P2, which together make up about one third of the total area of the sheet 10, are folded onto the two center panels P5, P6 which make up the center third of the area of sheet 10. Thus, with reference to FIGS. 1(*b*) and (*c*), the first fold 15 is formed such that the obverse sides of panels P1 and P2 lay upon the obverse sides of panels P5 and P6.

From FIG. 1(*c*) it becomes apparent that the sheet 10 is then folded along a second fold 20 that is parallel to the first fold 15. The second fold 20 is also located so that it divides off about one third of the total area of the sheet 10, or the two second side panels P3, P4 which are adjacent the second short side 10*b*2 of the rectangular sheet 10. Consequently, in this embodiment, the second fold 20 is approximately 4.25" from the near short side 10*b*2 of sheet 10, and approximately 8.5" from the far short side 10*b*1 of sheet 10. With reference to FIGS. 1(*c*) and 1(*d*), the second fold 20 is formed such that the obverse sides of panels P3 and P4 lay upon the reverse sides of panels P1 and P2.

The second side panels P3, P4, which together make up about one third of the total area of the sheet 10, are folded onto the first side panels P1, P2, which in turn have been folded onto the center panels P5, P6. The resultant configuration, which is commonly known as a "C-fold" configuration, is shown in FIG. 1(*d*). By folding the sheet 10 along both the first 15 and the second fold 20 into the "C-fold" configuration, the area thereof has been reduced to one third.

The C-fold is a common type of fold for tri-fold paper products such as brochures or letters, but also hand towels.

To allow the panels to nest inside each other properly, the folded in end panels, i.e. the first side panels P1, P2 in the present embodiment, can be made 1/32" to 1/8" narrower than the other panels.

In the configuration of FIG. 1(*d*), the reverse sides of the second side panels P3, P4 are facing upwards, the reverse sides being identified by female embossing patterns in the form of solid line circular elements 40. The reverse sides of the center panels P5, P6 are facing downwards.

In order to bring the sheet into its final configuration, the sheet 10 is then again folded along a third fold 25. The third fold 25 extends in parallel to the long sides 10*a*1, 10*a*2 of the rectangular sheet 10 so as to bisect the sheet 10. Starting with the configuration of FIG. 1(*d*), folding the sheet 10 along the third fold 25 reduces the area of the sheet 10 again by one half so that the total area of the sheet 10 is reduced to one sixth. This means that the surface of the folded sheet product is relatively small if compared with the surface of the unfolded sheet product. The resultant configuration is shown in FIG. 1(*f*). Folds 15, 20 and 25 have been formed such that the male projections 30 are located on the inside of the folded sheet, and the female recesses 40 are on the outside of the sheet. The reverse sides of the center panels P5, P6 with their female embossing patterns 40 are visible and facing upwards or downwards, respectively. Consequently, a user holding the folded sheet will touch substantially only the recessed embossments 40. This folding orientation in relation to the sidedness of the embossing pattern serves to provide an improved hand-feel for the outer surfaces of the sheet, while providing the improved absorbency due to the embossing.

In the case of TAD tissue or structure or textured tissue, the folding of the sheets can be effected such that the air side of the sheets is located on the inside of the folded sheet as described above in connection with the male projections, with the fabric side of the sheets then being on the outside surfaces of the folded sheet as described above in connection with the female recesses 40.

The fully folded sheet illustrated in FIG. 1(*f*) has dimensions of approximately 4.25"×4.25"

Note that, while the above embodiment employs non-square rectangular sheets having two long sides and two short sides, the sheet products can also be square having four equal sides. In this case, the first and second folds 15, 20 would run parallel to one of the sides of the square, and the third fold 25 would still be perpendicular to the first and second ones 15, 20.

Figure 2A:
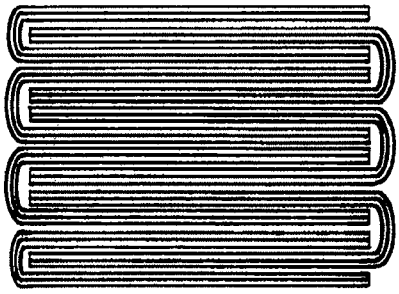
FIG. 2(*a*) is a schematic representation of the interfold configuration of a stack of folded absorbent sheet products according to the embodiment of FIG. 1(*a*)
Figure 2B:
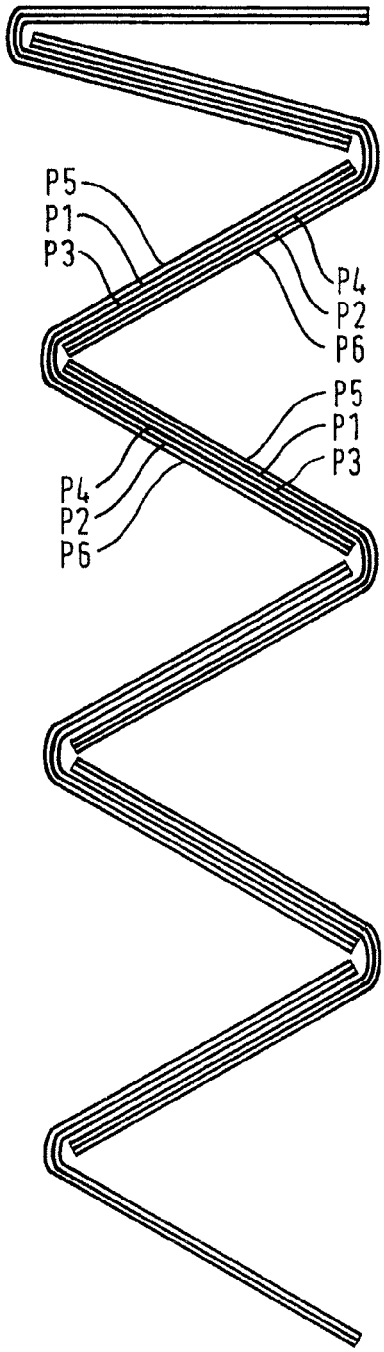

FIG. 2(*a*) depicts schematically the manner in which the folded sheets may be interfolded to form a stack of folded and interfolded sheets. As seen in FIG. 2(*a*), the interfolding of adjacent sheets is such that any given sheet within the stack receives, between three adjacent panels P3, P4 of the given sheet, three adjacent panels P4, P2, and P6 of the upper adjacent sheet within the stack and three adjacent panels P5, P1, and P3 of the lower adjacent sheet within the stack.

FIG. 2(*b*) shows the stack once it has been completed.

In the stack of interfolded sheets as depicted in FIGS. 2(*a*) and 2(*b*), there is no difference between the top of the stack and the bottom, in that the sheets will be dispensed the same way whether the stack is loaded into a dispenser top up or bottom up.

The interfolding takes place in a manner known as such, and therefore, no detailed explanation will be given in this regard. Web interfolding machines are described in U.S. Pat. Nos. 3,285,599 and 3,291,479, the entireties of which patents are hereby expressly incorporated by reference. In short, it can be said that the step of interfolding two sheets 10 is effected prior to effecting the third and final fold 25 of the individual sheets 10. In practice, two continuous sheet webs are folded into the configuration shown in FIG. 1 (*d*), i.e. the first 15 and the second folds 20 are formed. The sheet webs are then cut into individual, C-folded sheets 10 which are guided to an interfolding equipment in which they are placed onto one another in a manner offset by up to 50%. The sheets 10 are then folded along their respective third folds 25 so as to obtain the stacked configuration shown in FIGS. 2(*a*) and 2(*b*).

The folded absorbent sheet products can be discrete, that is, entirely detached from one another. However, it is also possible that the stack of absorbent sheet products be interconnected by "tabs", with the pulling force at the time of withdrawing a single absorbent sheet product through a dispensing opening being greater than or equal to the force required to tear the tabs connecting adjacent absorbent sheet products.

When the products are interconnected by tabs, the interfolding arrangement described herein recommends that the stack of absorbent sheet products be formed in a pair of parallel "lanes", such that, it is in fact alternate absorbent sheet products that are joined together, rather than consecutive absorbent sheet products. That type of parallel lane or web arrangement is described for example in U.S. Pat. No. 6,213,346.

The disclosure also contemplates the use of the novel stack of absorbent sheet products in a variety of dispensers. One example is a dispenser having a downwardly-directed opening, such as that described in commonly-owned co-pending application Ser. No. 10/660,659, the entirety of which is hereby expressly incorporated by reference. Other examples are dispensers having an upwardly directed opening, or a lateral opening. A dispenser having an upwardly directed opening and suited for dispensing the absorbent sheet products is described in commonly-owned U.S. Pat. No. 7,178,689, the entirety of which is hereby expressly incorporated by reference.

While the present invention has been described in connection with various preferred embodiments thereof, it is to be understood that those embodiments are provided merely to illustrate the invention, and should not be used as a pretext to limit the scope of protection as it is defined by the appended claims.

First of all, in the above embodiment, each absorbent sheet product 10 includes six panels. However, in other embodiments, the absorbent sheet products having several layers of six panels each. For example, each absorbent sheet product could include twelve panels which are arranged in a pattern of 3×4 panels. Prior to folding, the sheet can have dimensions of approximately 17"×13", i.e. twice the 8.5"×13" of the above embodiment.

The sheet is then folded onto itself along a fold bisecting the sheet, so that the resultant configuration is a double layer sheet having two layers of 3×2 panels each. The resultant double layer sheet is then folded in the same manner as described above for the six panel sheet.

Secondly, in the above embodiment, the sheet products include six panels which all have the same size. In other embodiments, it is possible to fold the sheet products so that the size of the individual panels is different. In particular, the above embodiment could be modified so that the first side panels P1, P2 and the second side panels P3, P4 are narrower than the center panels P5, P6 onto which they are folded. The size of the folded product would then be determined by the size of the larger center panels P5, P6.

Thirdly, in the above embodiment, the third fold 25 is arranged so as to bisect the sheet 10, so that folding the sheet 10 along the third fold 25 reduces the area of the sheet 10 again by one half. However, the third fold 25 could as well be offset from the center of the product and does not necessarily bisect the product into two equal parts.

Finally, in the above embodiment, the folds 15, 20 and 25 have been formed such that the male projections 30 are located on the inside of the folded sheet, and the female recesses 40 are on the outside of the sheet. However, the opposite configuration could also be realized, in which the folds 15, 20 and 25 are formed such that the male projections 30 are located on the outside of the folded sheet, and the female recesses 40 are on the inside of the sheet.

What is claimed is:

1. A stack of interfolded absorbent sheet products comprising a plurality of absorbent sheets, wherein each of the sheets comprises a first fold, a second fold running parallel to the first fold, and a third fold which is perpendicular to the first and second folds, so that the three folds define a pattern of 3×2 panels, including two first side panels, two center panels, and two second side panels, wherein each of the sheets has its first side panels folded onto its center panels, its second side panels folded onto its first side panels in a C-fold, and its second side panels then folded onto each other so as to obtain a folded configuration including at least six panels, wherein each of the sheets within said stack receives, between two inwardly facing adjacent panels, three adjacent panels from each of two sheet products disposed respectively above and below said sheet product in said stack, wherein each of the sheets includes a three-dimensional relief pattern, wherein one side of the sheet contains only protruding portions of the three-dimensional relief pattern and the opposite side of the sheet contains only recessed portions of the three-dimensional relief pattern, and wherein each sheet is folded such that exterior panels of each sheet, when folded, comprise the side of the sheet containing only recessed portions of the three-dimensional relief pattern.

2. The stack of interfolded absorbent sheet products according to claim 1, wherein the absorbent sheets each have a generally rectangular shape, which may be square or non-square, and the first and second folds are parallel to one side of the generally rectangular shape.

3. The stack of interfolded absorbent sheet products according to claim 2, wherein the absorbent sheets each have a non-square rectangular shape, and the first and second folds are parallel to the short sides of the rectangular shape.

4. The stack of absorbent sheet products according to claim 1, wherein said first, second and third folds define six panels of equal width and length.

5. The stack of absorbent sheet products according to claim 1, wherein each of said sheets has folded dimensions of approximately 4.25" by 4.25".

6. The stack of absorbent sheet products according to claim 1, wherein each of said sheets has unfolded dimensions of approximately 8.5" by 13".

7. The stack of interfolded absorbent sheet products according to claim 1, wherein each of said sheets is a single ply or multi-ply paper sheet with each ply having a basis weight of from about 8 to 20 lb.

8. The stack of interfolded absorbent sheet products according to claim 1, wherein each of said sheets includes at least two interconnected layers of six panels, each of which are folded onto each other.

9. The stack of interfolded absorbent sheet products according to claim 1, wherein each of said sheets is entirely detached from all other absorbent sheet products within said stack.

10. The stack of interfolded absorbent sheet products according to claim 1, wherein each of said sheets is attached by tabs to one or two other absorbent sheet products within said stack.

11. The stack of interfolded absorbent sheet products according to claim 1, wherein the relief pattern is an embossed surface relief applied by embossing rollers during a converting phase of manufacturing said absorbent sheet products.

12. The stack of interfolded absorbent sheet products according to claim 11, wherein said embossed surface relief is of a continuous pattern over an entire surface of said sheets.

13. The stack of interfolded absorbent sheet products according to claim 11, wherein said embossed surface relief is applied only along a peripheral region of said sheets.

14. The stack of interfolded absorbent sheet products according to claim 1, wherein each of said sheets is TAD tissue or structure or textured tissue, made using a process using pressure, vacuum, or air flow through the wet web, each of said sheets having an air side and a fabric side.

15. The stack of interfolded absorbent sheet products according to claim 14, wherein each sheet is folded such that exterior panels of each sheet when folded comprise said fabric side of each sheet.

16. The stack of interfolded absorbent sheet products according to claim 1, wherein the absorbent sheet products are paper napkins.

* * * * *